US010226715B2

(12) United States Patent
Barber

(10) Patent No.: US 10,226,715 B2
(45) Date of Patent: Mar. 12, 2019

(54) DISPLAY PANEL SYSTEM

(71) Applicant: Atomic Design Inc., Lititz, PA (US)

(72) Inventor: Robert J. Barber, Lancaster, PA (US)

(73) Assignee: Atomic Design Inc., Lititz, PA (US)

( * ) Notice: Subject to any disclaimer, the term of this patent is extended or adjusted under 35 U.S.C. 154(b) by 0 days.

(21) Appl. No.: 15/728,107

(22) Filed: Oct. 9, 2017

(65) Prior Publication Data

US 2018/0028933 A1 Feb. 1, 2018

Related U.S. Application Data

(63) Continuation-in-part of application No. 29/542,476, filed on Oct. 14, 2015, now Pat. No. Des. 815,689.

(51) Int. Cl.

| | |
|---|---|
| ***A63J 1/02*** | (2006.01) |
| ***A47H 13/00*** | (2006.01) |
| ***A47H 13/02*** | (2006.01) |
| *B66D 1/00* | (2006.01) |

(52) U.S. Cl.

CPC ..... *A63J 1/028* (2013.01); *A47H 13/00* (2013.01); *A47H 13/02* (2013.01); *A63J 1/02* (2013.01)

(58) Field of Classification Search

CPC ..... A63J 1/00; A63J 1/02; A63J 1/028; B66D 1/00; B66D 1/74; G09F 7/18; G09F 15/00; G09F 15/0012; G09F 15/0018; G09F 15/0056

USPC ..... 472/77–80; 40/606.01, 606.03, 606.11, 40/607.11, 618, 620

See application file for complete search history.

(56) References Cited

U.S. PATENT DOCUMENTS

| | | | | |
|---|---|---|---|---|
| 1,232,189 | A * | 7/1917 | Bernstein | G09F 7/22 211/87.01 |
| 1,525,515 | A | 2/1925 | Socha | |
| 2,692,689 | A | 10/1954 | Wynne, Sr. | |
| 2,970,396 | A | 2/1961 | Worrell | |
| 3,426,913 | A | 2/1969 | Abatiell, Jr. | |
| 3,537,199 | A | 11/1970 | Lawson | |
| 3,571,999 | A | 3/1971 | Downing | |
| 3,593,474 | A | 7/1971 | Neels | |
| 3,596,701 | A | 8/1971 | Cowan | |
| 3,936,111 | A | 2/1976 | Mazzucconi | |

(Continued)

FOREIGN PATENT DOCUMENTS

| | | |
|---|---|---|
| AU | 2012261483 A1 | 6/2013 |
| CA | 1263233 A1 | 11/1989 |

(Continued)

OTHER PUBLICATIONS

Installation Instructions for Pillow Wall, by Atomic, www.atomicrental.tv, (717-626-4408), dated Nov. 25, 2013, 1 page.

(Continued)

*Primary Examiner* — Kien Nguyen
(74) *Attorney, Agent, or Firm* — Barley Snyder

(57) ABSTRACT

A display panel system is provided and includes a plurality of planar polygonal display panels, each display panel removably connectible along at least one edge to an edge of an adjacent display panel with connectible zipper assemblies. Each display panel system may be composed of uniform material or of various materials. The display panel system may be draped as desired by use of suspension mechanisms and rigging lines.

15 Claims, 9 Drawing Sheets

(56) References Cited

U.S. PATENT DOCUMENTS

| | | | | |
|---|---|---|---|---|
| 4,001,987 | A | 1/1977 | Coulthard | |
| 4,114,160 | A | 9/1978 | Verini | |
| 4,807,837 | A | 2/1989 | Gawlik et al. | |
| 5,036,641 | A | 8/1991 | Viry | |
| 5,061,018 | A | 10/1991 | Pederson et al. | |
| 5,344,115 | A | 9/1994 | Mayne et al. | |
| 5,478,041 | A | 12/1995 | Mayne | |
| 5,671,852 | A | 9/1997 | Maharg | |
| 5,722,477 | A | 3/1998 | Richter et al. | |
| 5,993,287 | A | 11/1999 | Melashenko et al. | |
| 6,276,083 | B1 * | 8/2001 | Ross | G09F 15/0025 116/173 |
| 6,340,046 | B1 | 1/2002 | Basseches | |
| 6,370,803 | B1 | 4/2002 | Burquest | |
| 6,419,332 | B1 | 7/2002 | Caldwell, Jr. et al. | |
| 6,702,640 | B1 | 3/2004 | Park | |
| 6,718,709 | B2 | 4/2004 | Koutras et al. | |
| 6,983,853 | B1 | 1/2006 | Fickett | |
| D618,282 | S | 6/2010 | Kosir | |
| 7,874,090 | B2 | 1/2011 | Flagg | |
| D634,745 | S | 3/2011 | Park et al. | |
| 8,069,632 | B2 | 12/2011 | Li | |
| 8,083,189 | B2 | 12/2011 | Sun et al. | |
| 8,474,168 | B2 * | 7/2013 | Wick | G09F 7/18 248/322 |
| D699,466 | S * | 2/2014 | Babcock | D6/514 |
| D708,504 | S | 7/2014 | Kaplan | |
| D709,203 | S | 7/2014 | Toshiba et al. | |
| D723,624 | S | 3/2015 | McPhillips | |
| D736,858 | S | 8/2015 | McPhillips | |
| 2002/0036908 | A1 | 3/2002 | Pederson | |
| 2002/0154789 | A1 | 10/2002 | Rodgers | |
| 2003/0000904 | A1 | 1/2003 | Lung et al. | |
| 2003/0192271 | A1 | 10/2003 | Koutras et al. | |
| 2004/0035987 | A1 | 2/2004 | Oddsen, Jr. | |
| 2004/0089782 | A1 | 5/2004 | Eliason et al. | |
| 2007/0107853 | A1 | 5/2007 | Hsieh | |
| 2009/0134285 | A1 | 5/2009 | Huang | |
| 2009/0196034 | A1 | 8/2009 | Gherardini et al. | |
| 2009/0298385 | A1 * | 12/2009 | Brinckerhoff | A63H 33/008 446/487 |
| 2011/0168220 | A1 * | 7/2011 | Prusmack | E04B 1/32 135/135 |
| 2012/0169999 | A1 | 7/2012 | Cavendish et al. | |
| 2014/0183309 | A1 | 7/2014 | Pasho | |
| 2014/0197123 | A1 | 7/2014 | McPhillips | |

FOREIGN PATENT DOCUMENTS

| | | | |
|---|---|---|---|
| DE | 8517546.3 | U1 | 1/1985 |
| DE | 29820223 | U1 | 2/1999 |
| DE | 10138986 | A | 3/2003 |
| DE | 102011015351 | A1 | 10/2012 |
| EP | 1995508 | A2 | 11/2008 |
| FR | 2851442 | A1 | 2/2003 |

OTHER PUBLICATIONS

PCT Notification, International Search Report and Written Opinion, International Application No. PCT/US2014/011055, dated Jun. 2, 2014, 10 pages.

PCT Notification, International Search Report, International Application No. PCT/US2014/061074, dated Feb. 25, 2015, 12 pages.

PCT Notification and International Preliminary Report on Patentability, Application No. PCT/US2014/011055, dated Jul. 14, 2015, 7 pages.

PCT Notification, International Search Report and Written Opinion of the International Search Authority, Intl. App. No. PCT/US2015/031782, dated Aug. 14, 2015, 11 pages.

* cited by examiner

DISPLAY PANEL SYSTEM

CROSS-REFERENCE TO RELATED APPLICATIONS

This application is a continuation-in-part of design patent application 29/542,476, filed Oct. 14, 2015.

FIELD OF THE INVENTION

The present invention relates to a display panel system and, more particularly, to a display panel system for assembling and displaying panels for theatrical and promotional events.

BACKGROUND

Theatrical staging techniques include the suspending of curtains or drapes to shield, mask, partition, decorate, or mark areas of a display, a stage, or other performance area. Where staging is only temporary, or must be relocated to a series of dissimilar sites, traditional options for crafting, assembling, and installing curtains have proved unsatisfactorily expensive, cumbersome, and inflexible. In particular, where such sites are of dissimilar dimensions, it has proved challenging to design, assemble, and install such curtains or drapes in an economical and convenient manner. Attempts to create a business designing and renting curtains and drapes for such events have proved difficult with traditional approaches.

SUMMARY

A display panel system is provided and includes a plurality of planar polygonal display panels, each display panel removably connectible along at least one edge to an edge of an adjacent display panel with connectible zipper assemblies. Each display panel system may be composed of uniform material or of various materials. The display panel system may be draped as desired by use of suspension mechanisms and rigging lines.

BRIEF DESCRIPTION OF THE DRAWINGS

The invention will be explained in greater detail with reference to embodiments, referring to the appended drawings, in which.

DETAILED DESCRIPTION OF THE EMBODIMENT(S)

Figure 1:
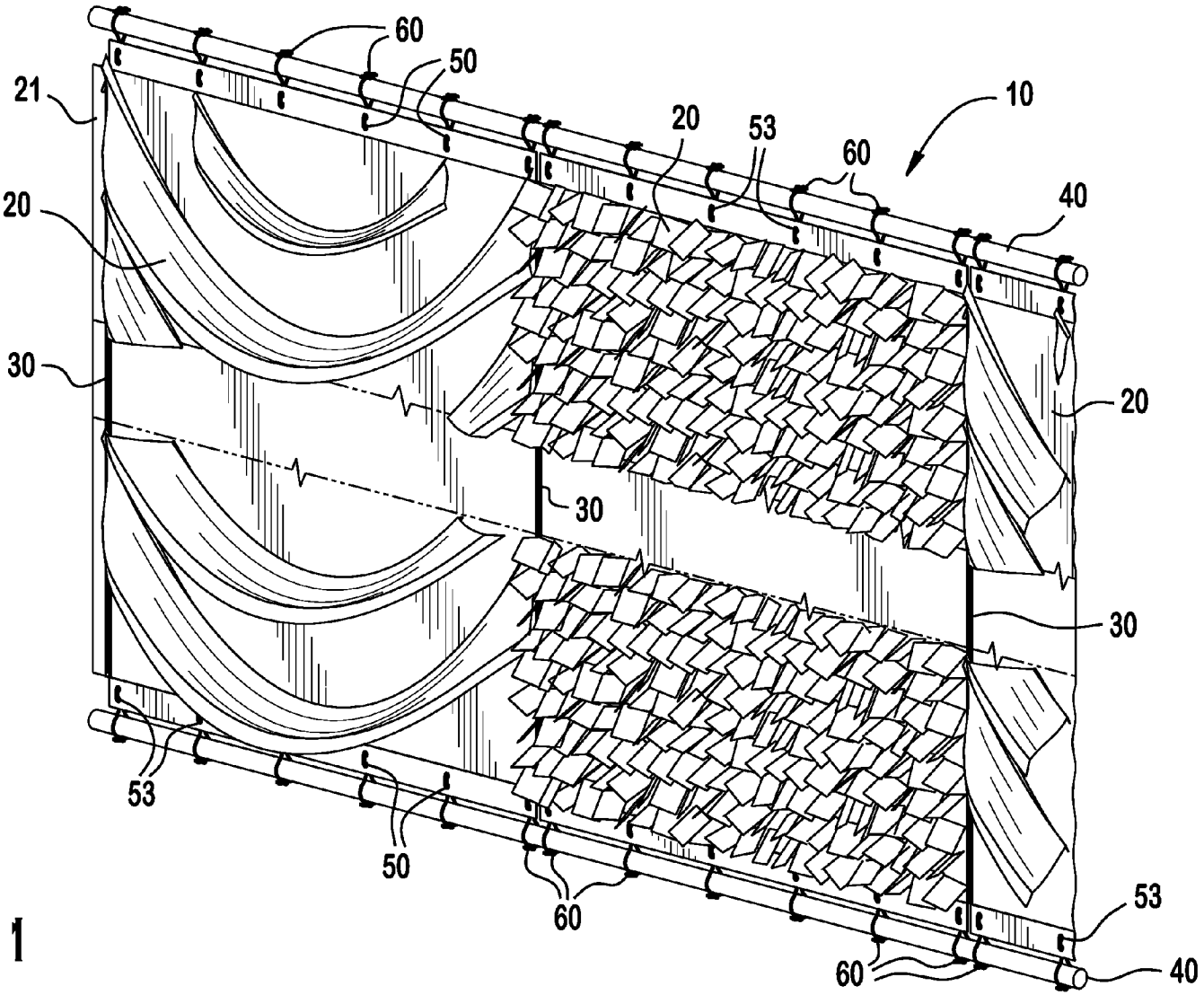
FIG. 1 is a perspective view of a panel display panel system according to the invention.

The subject matter of the invention will be disclosed in detail in the accompanying description and drawings which present several embodiments. The present disclosure may, however, be embodied in many different forms and should not be construed as being limited to the embodiments set forth herein. Rather, these embodiments are provided so that the present disclosure will be thorough and complete and will fully convey the concept of the disclosure to one of skill in the art. Within the accompanying drawings reference numerals are used consistently throughout the views to designate identical or corresponding elements.

The phrase "display panel system" refers to an assemblage of the described elements of the invention assembled for a particular venue and effect. The phrase "display panel system" also refers to a collection of the described elements from which particular panels are chosen for assembly into a particular venue and effect. The collection of elements contains panels of various materials, textures, and effects and is useful for setting up a business to rent particular display panel systems to clients in need of such service and product.

Now with reference to FIGS. 1-8, a display panel system 10 according to the invention will be described.

As shown, the display panel system 10 generally includes the following major components: a plurality of panels 20, a plurality of zipper assemblies 30, a truss element 40, and a plurality of rigging points 50. In the embodiment shown, the plurality of panels 20 are removably assembled with the use of zipper assemblies 30 positioned on adjacent edges 22 thereof. The zipper assemblies 30 are positioned to permit adjacent edges 22 to be assembled and shown in the exemplary embodiments in FIGS. 1-8. The plurality of panels 20 are so assembled to obtain a lateral width and vertical height suitable to a particular staging area.

In practice, the display panel system 10 of the invention will be used to outfit a variety of venues with temporary displays and therefore individual panels 20 are sized to allow flexibility in meeting the needs of the clients. For instance, stages and venues are of differing widths and heights. Therefore, the width and height of an individual display panel 20 is chosen to permit a display panel system 10 to be assembled to suit the dimensions of a wide variety of staging locations. For instance, the polygonal display panels 20 are individually of a width ranging from about four feet to about five feet in width. More particularly, the polygonal display panels 20 are individually of a width ranging from about four feet to about eight feet. Most particularly, the polygonal display panels 20 are individually of a width ranging from about five feet to about seven feet. Especially most preferably, the polygonal display panels 20 are individually about five feet wide. Additionally, the polygonal display panels are individually of a height ranging from about 20 feet to about 30 feet. More particularly, the polygonal display panels are individually of a width ranging from about 4 feet to about 5 feet. Most particularly, the polygonal display panels are individually of a width ranging from about 4 feet to about 5 feet. In one preferred embodiment of the invention, the polygonal display panel is five feet wide by 30 feet high. Additionally, the polygonal display panels may be individually of a generally triangular shape.

Figure 2:
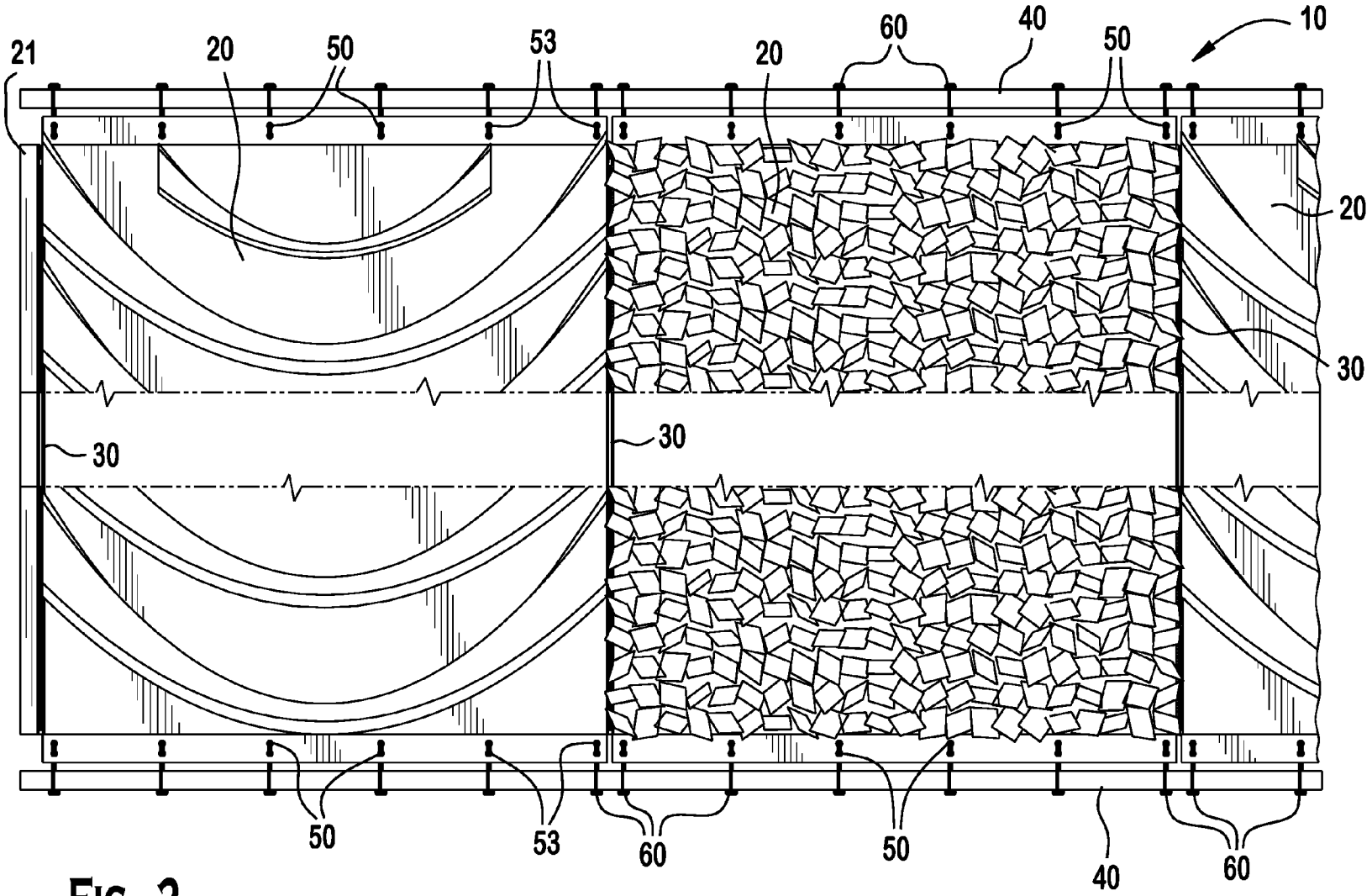
FIG. 2 is a front view of the panel display system of FIG. 1.
Figure 3:
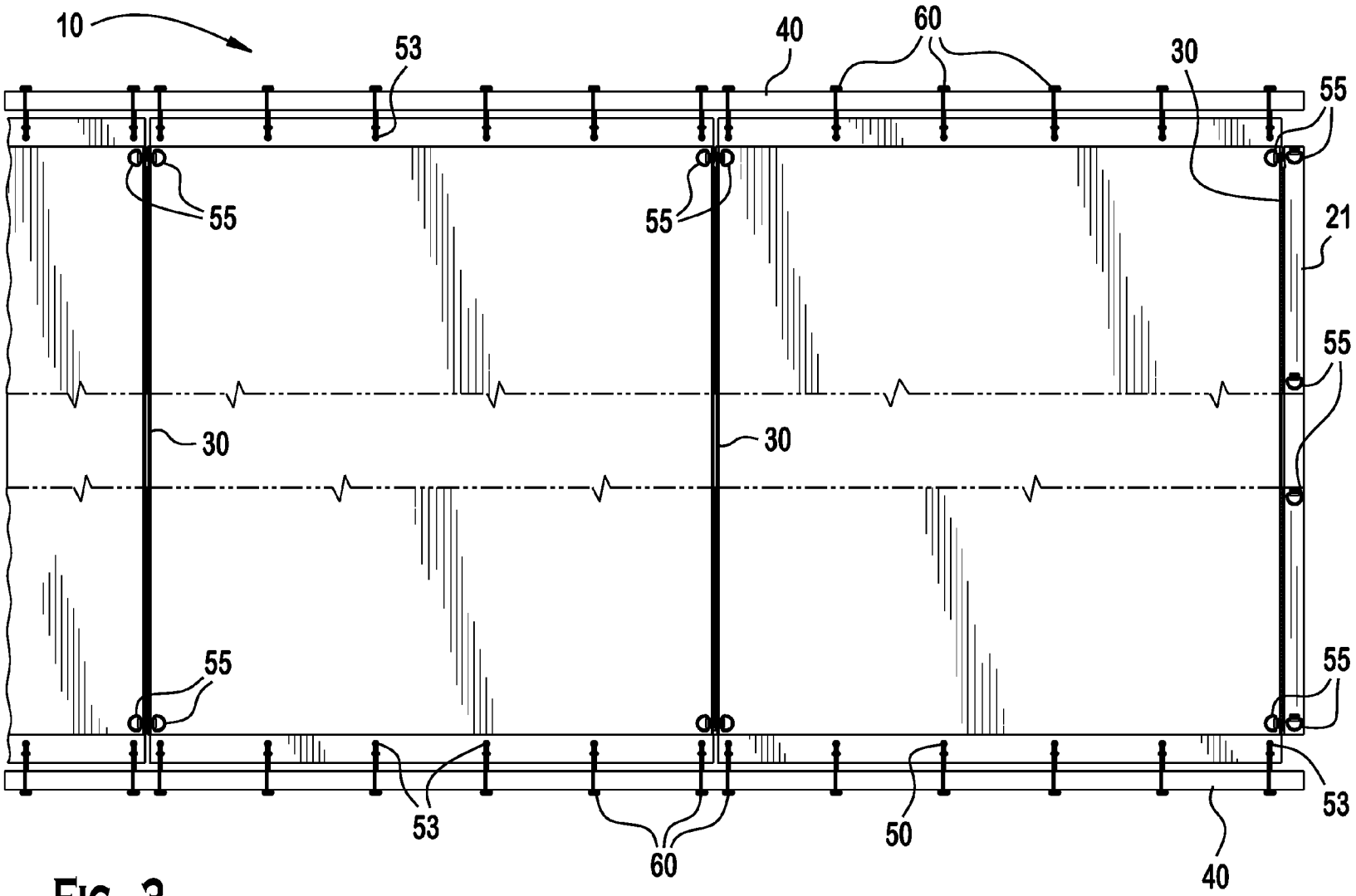
FIG. 3 is a rear view of the panel display system of FIG. 1.
Figure 4:
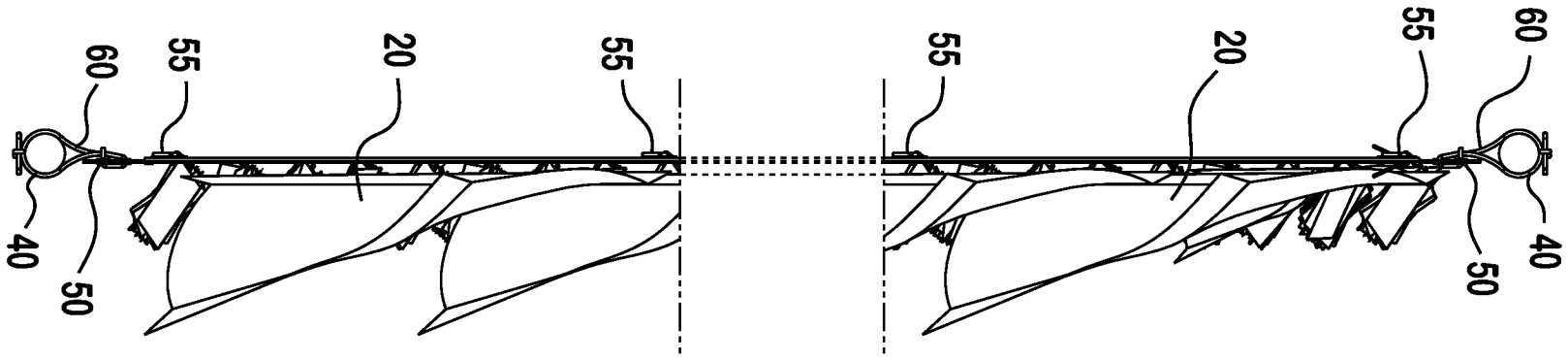
FIG. 4 is a left side view of the panel display system of FIG. 1.
Figure 5:
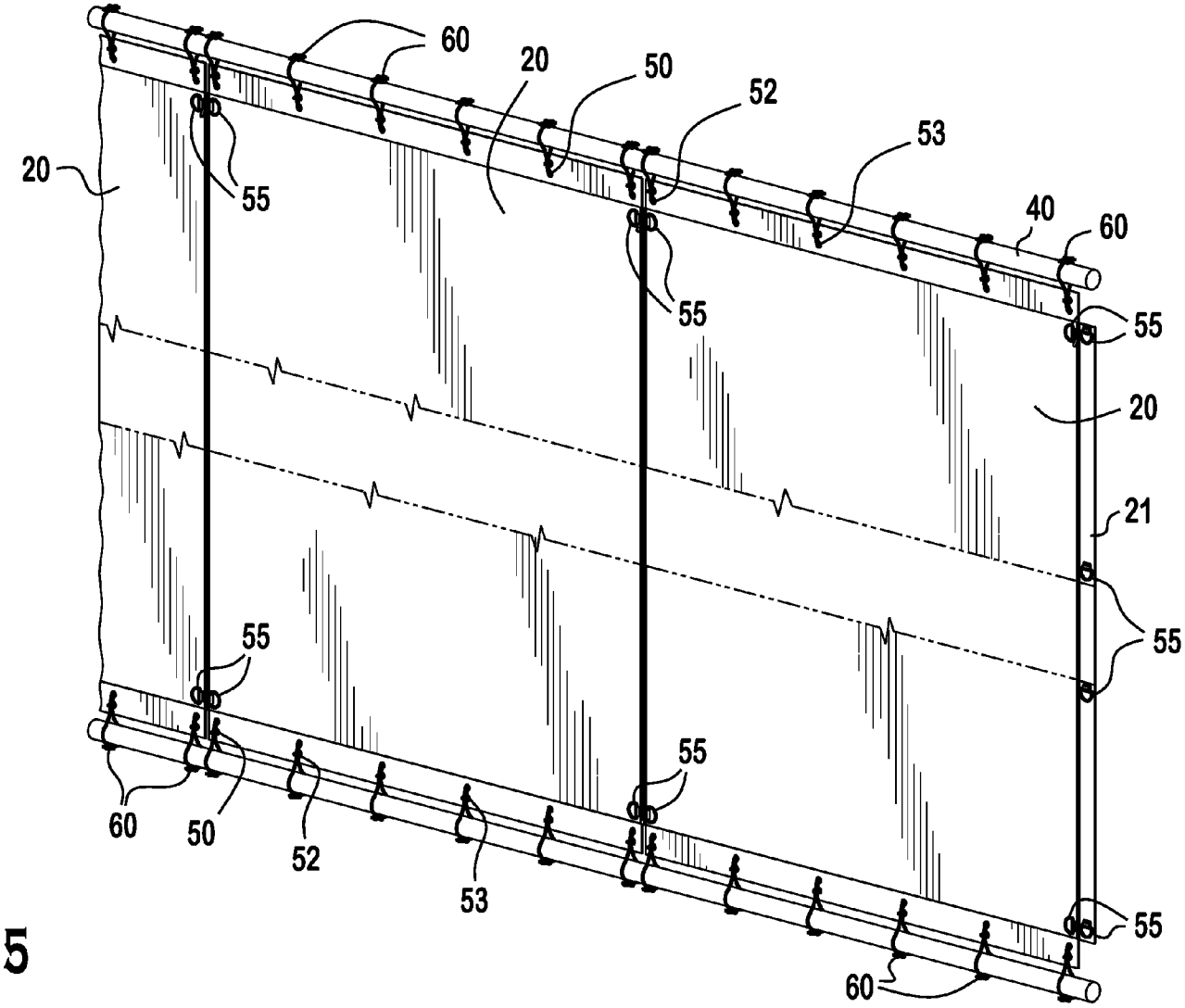
FIG. 5 is a rear perspective view of the panel display system of FIG. 1.
Figure 6:
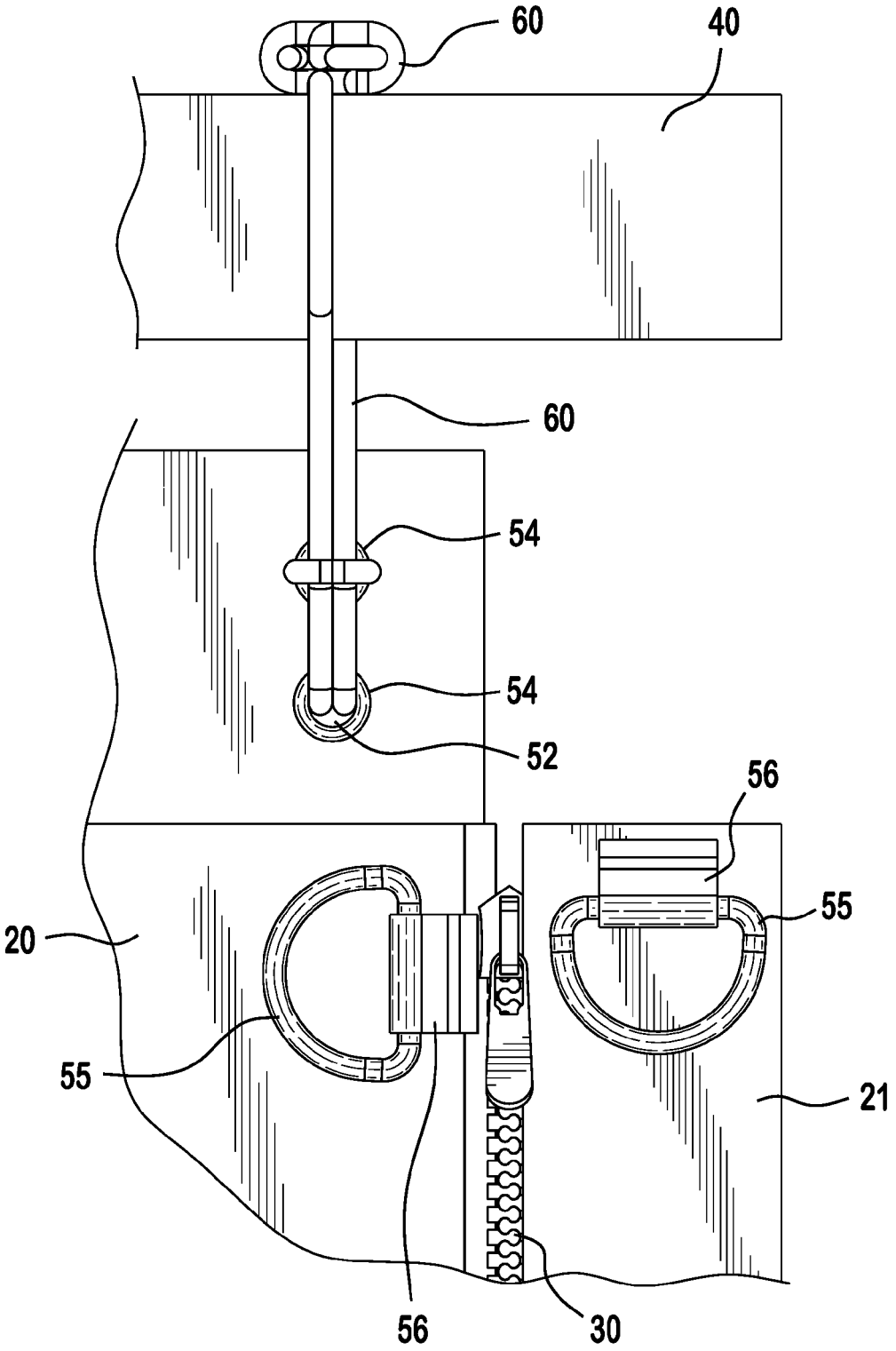
FIG. 6 is a detailed view of a section of the panel display system of FIG. 5.
Figure 7A:
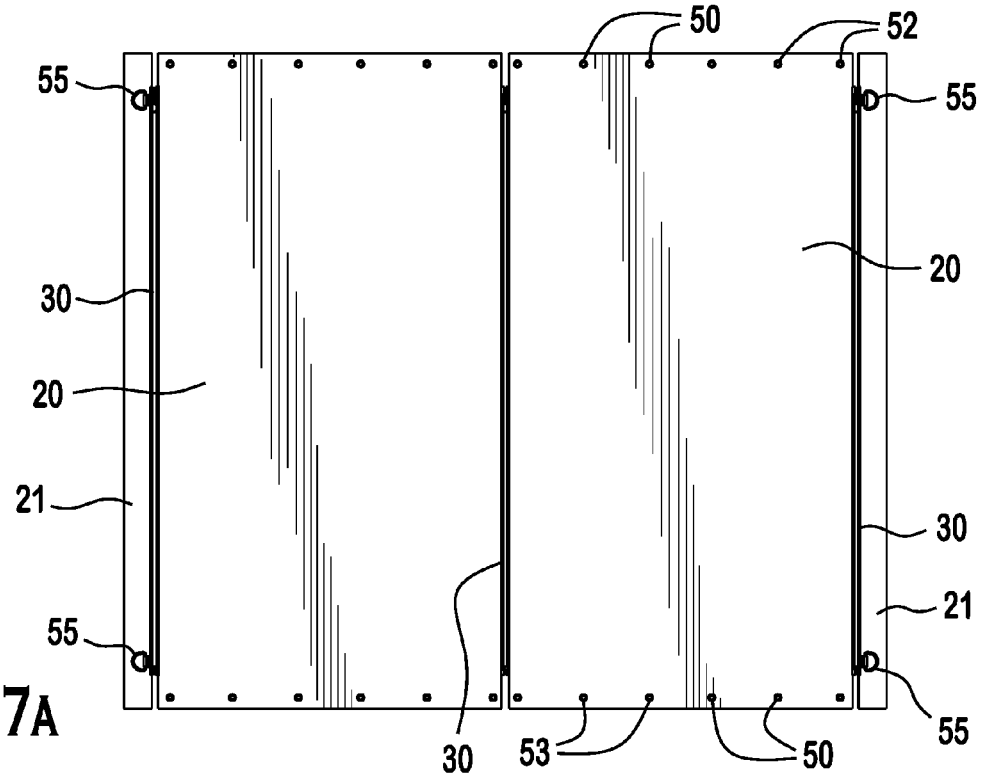
FIG. 7*a* is a front view of another panel display system according to the invention, showing a vertical arrangement of panels thereof.
Figure 7B:
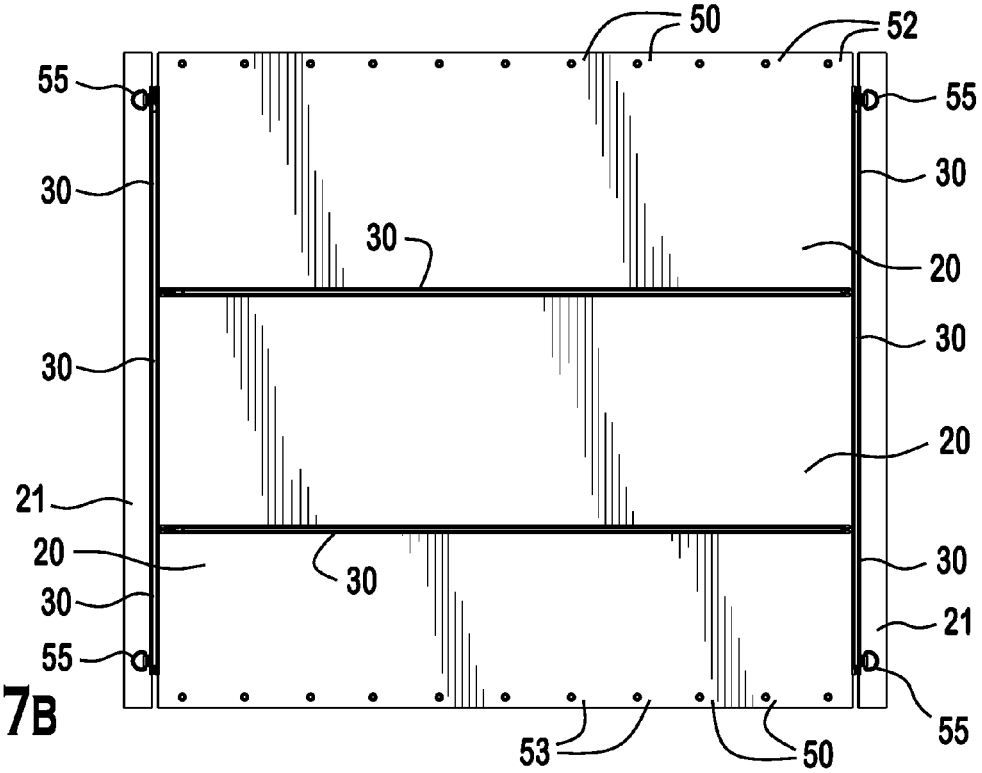
FIG. 7*b* is a front view of another panel display system according to the invention, showing a horizontal arrangement of panels thereof.
Figure 7C:
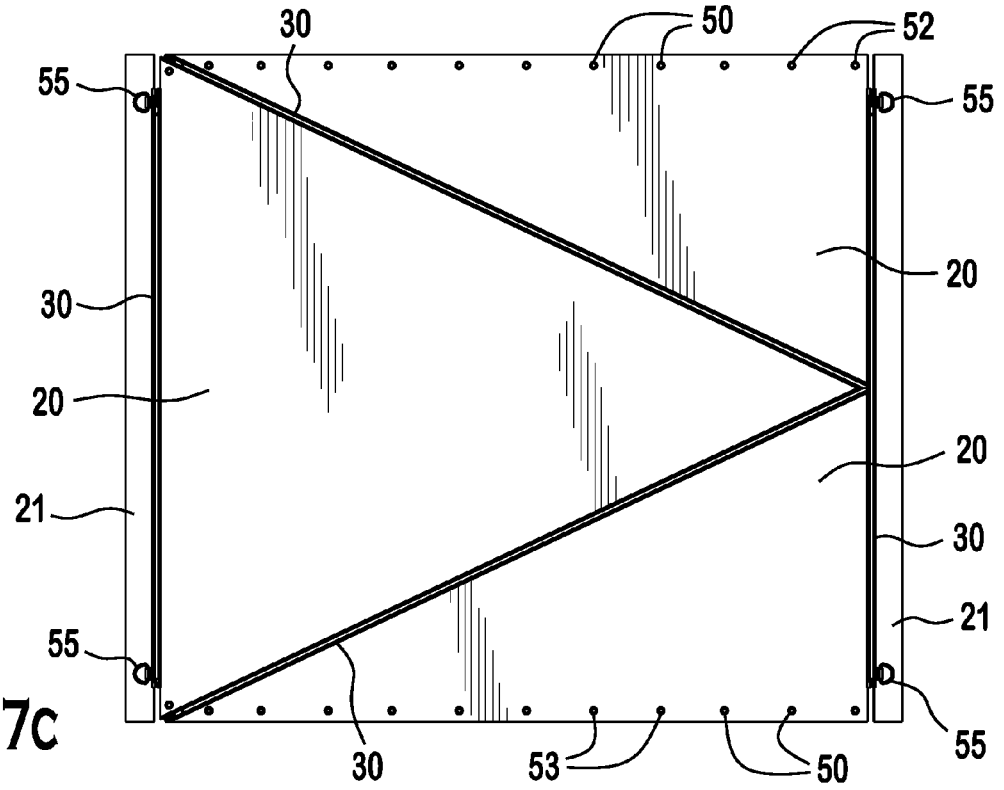
FIG. 7*c* is a front view of another panel display system according to the invention, showing a triangular arrangement of panels thereof.
Figure 7D:
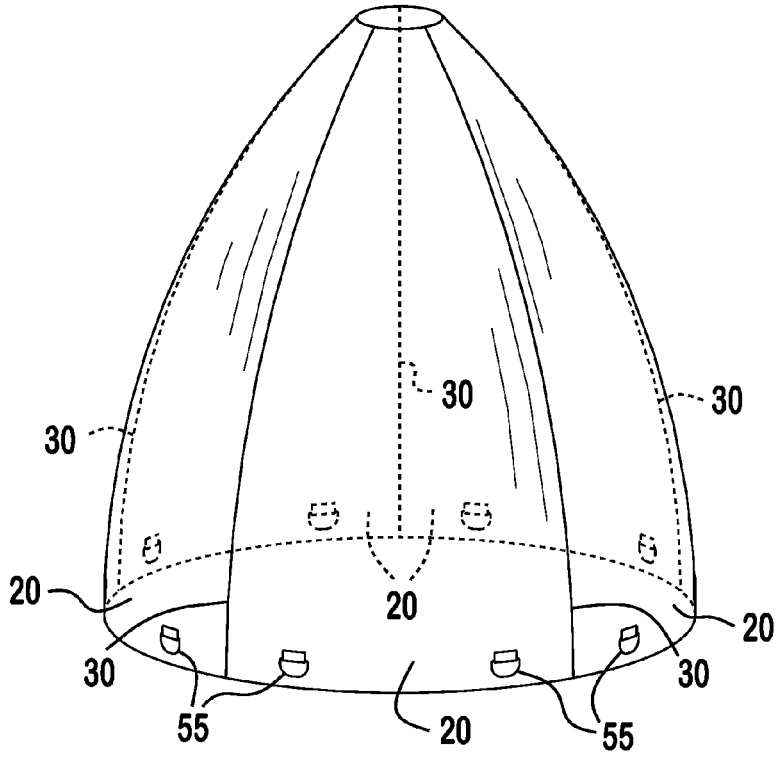
FIG. 7*d* is a front view of another panel display system according to the invention, showing a tent shaped arrangement of panels thereof.

As shown in FIGS. 1-3 and 5, 7-8, an individual display panel 20 is a planar polygon. All display panels 20 may be constructed of the same material or texture or each display panel 20 may be constructed of a different material or texture as indicated by the purpose for which the display panel system 10 will be used. For example, it may be desirable that the display panel system 10 be constructed of a uniform color, texture, or other effect, in which case the plurality of panels 20 will be uniform. In another instance, it may be desirable that the display panel system 10 include more than one color, texture, or other effect, in which case the plurality of panels 20 will be assembled with that goal in mind. The effects and textures of the panels 20 may be widely varied and include various fabrics, colors, and effects including, for example, feathers, ruffles, ruching, pleats, gathering, fringe, light emitting diode (LED) lighting, and other theatrical effects as are known to one of ordinary skill in the art. FIGS. 1, 2, and 4 show a display panel system 10 using more than one display panel texture or effect.

The widths of the individual display panels 20 may be uniform or a display panel system 10 may be assembled of individual display panels 20 of varied widths. In exemplary embodiments, shown in FIGS. 1, 2, 3, 5, 6, 7, and 8, each panel 20 is of different width. A first panel width 20*a* contains a material and texture chosen for display effects. A finish panel 21 provides a zipper assembly 30 on an inner edge 22*c* and a finished, non-zipper outer edge 22*d*. Additionally, display panels 20 may be of varied widths.

The display panels 20 are removably connectible along at least one edge 22 to an edge of an adjacent display panel 20 with connectible zipper assemblies 30. The zipper assemblies 30 are of the separating (open end) type that permit complete removal of one panel from an adjacent panel.

The display panels may be assembled with zipper assemblies 30 vertically or horizontally as shown in FIG. 1-8, but are preferably assembled vertically with the assembled display panel system 10 suspended from a truss element 40 with rigging points 50 threaded with rigging lines 60. The rigging points 50 are of various construction as described below.

The display panels have a plurality of rigging points 50 including rigging line receiving passageways 52 through which rigging lines 60 are arranged to suspend or secure the display panels 20 to a first truss element 40 or other anchoring point. The rigging line receiving passageways 52 are locations on a display panel 20 that have been pierced or cut. As the rigging line receiving passageways 52 are typically areas of high stress, reinforcing material may be added to the panels in these locations. For instance, grommets 53 and eyelets (not illustrated) are rings or continuous edge strips affixed at a rigging line receiving passageway 52 or series of rigging line receiving passageways where the panel material is pierced or penetrated. The rigging line 60 runs through the grommet 53 or eyelet at each of these points and is used to secure the display panel 20 to the truss element 40 or other anchor point. The grommets 53 or eyelets are made of metal, plastic, or rubber or other suitable material. The grommets 53 or eyelets are used to prevent tearing or abrasion of the panel material by the rigging line 60, to protect the rigging line 60 from abrasion, and to smooth the passage of the rigging line 60 through the rigging line receiving passageway 52.

The grommets 53, eyelets, and the like may be affixed to the panel material at an upper edge 22*a*, a lower edge 22*b*, or at both. Rigging line receiving passageways 52 on an upper edge 22*a* are used to suspend the display panel 20 from a first truss element 40. Rigging line receiving passageways 52 on a lower edge 22*b* are used to secure the display panel 20 to a second truss element 40 and to limit its movement.

Figure 8:
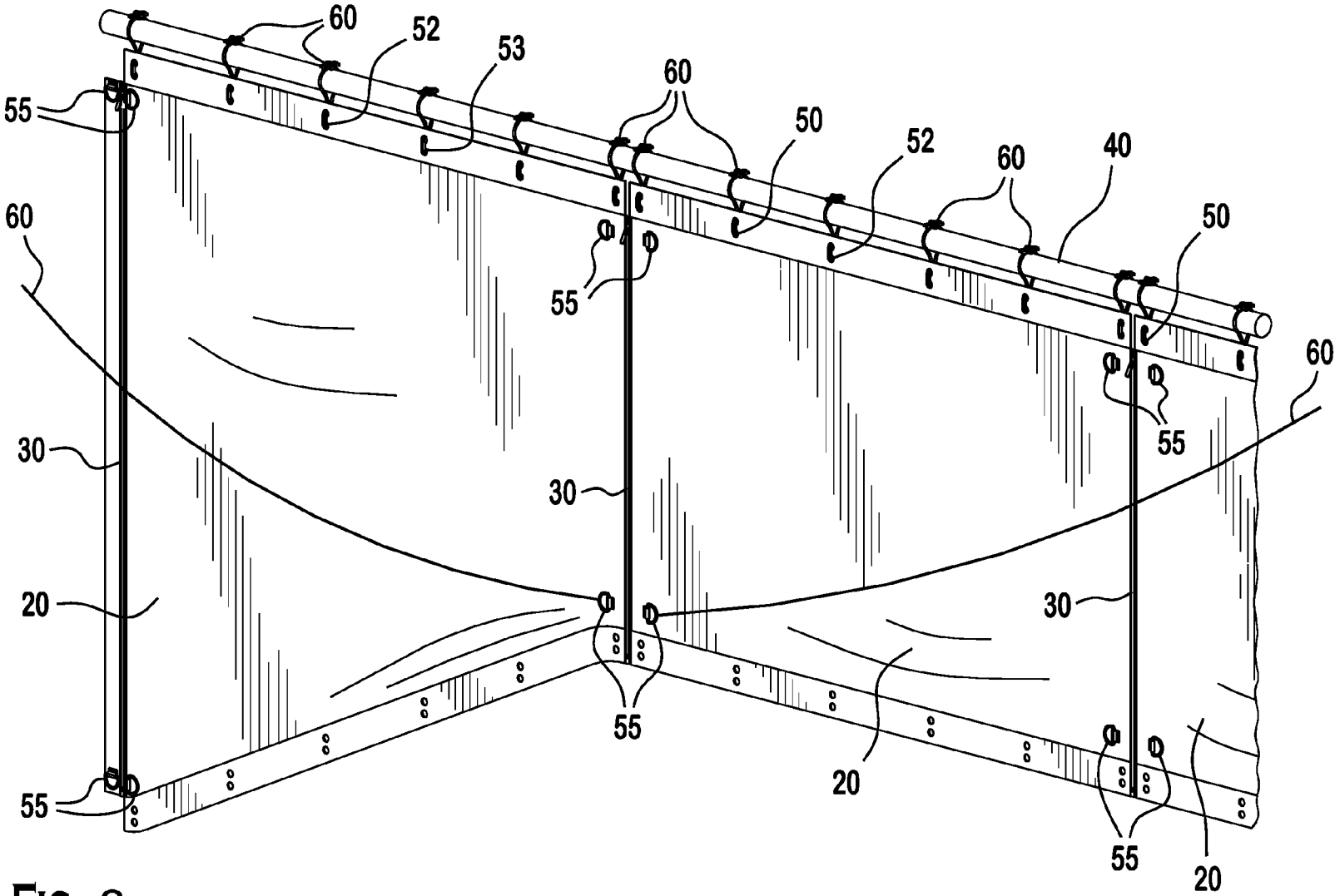
FIG. 8 is a rear perspective view of a display panel system according to the invention, showing a draping arrangement using of suspension mechanisms according to the invention and known rigging lines.

The display panels 20 may also have rigging points 50 in the form of suspension mechanisms 55 affixed to a plurality of locations. In the shown embodiment, the suspension mechanisms 55 are D-rings or hardware shaped like the letter "D" and used primarily as a lashing point through which a rigging line 60 may be threaded. The rigging line 60 threaded through a suspension mechanism 55 is used to vary the drape of the display panel system 10 from a generally 2-dimensional curtain to provide a 3-dimensional effect on the display panel system as shown in FIG. 8 (draped or tent-like). The material and strength of the suspension mechanism 55 is chosen to reflect the stresses experienced in use and may vary in composition, geometry, weight, finish, and load capacity as known by those of ordinary skill in the art of theatrical staging. The suspension mechanism 55 is preferably forged and not metal or plastic bent into shape. Forging prevents the ends of the metal suspension mechanism 55 from separating under stress it is subjected to. The location of the suspension mechanisms 55 may be along an edge 22 of the panel 20 or may be located as desired at any location on the panel 20. According to the invention, the suspension mechanism 55 is secured with a reinforcing strap or tape 56 to the display panel 20. When installed, the suspension mechanism 55 location is typically, but not necessarily, on the upstage side of the display panel system 10, i.e., on the side of the panel facing away from an audience.

A display panel system 10 is installed by attaching an individual panel 20 to a first truss element 40 using a rigging line 60 threaded through the rigging line receiving passageways 50 along the upper edge 22*a* of the display panel 20. Adjacent panels 20 are connected using zipper assemblies 30. The number of panels is chosen to obtain a width of the display panel system 10 that is appropriate for the venue in which it will be used. The particular panels 20 assembled are chosen to suit the particular effect desired. A finish panel 21 may be connected by zipper assemblies to the outside edges 22*d* of the display panel system 10 to create a finished edge (without an exposed zipper assembly) to the display panel system 10. Finally, the display panel system 10 is raised into place with a fly system (not shown) or a line set (not shown) designed by one of ordinary skill in the art of theatrical rigging.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range.

Unless defined otherwise, all technical and scientific terms used herein have the same meaning as commonly understood by one of ordinary skill in the art to which the invention belongs. In case of conflict, the present application including the definitions will control. Also, unless otherwise required by context, singular terms shall include pluralities and plural terms shall include the singular Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. A display panel system comprising:

a truss element;

a rigging line extending from the truss element; and a plurality of planar polygonal display panels, each display panel having a:

a zipper assembly positioned along an edge thereof and connectible along to an adjacent display panel having a corresponding zipper assembly;

a plurality of rigging points positioned along a body of the display panel and secured to the rigging line.

2. The display panel system of claim 1, wherein a first subset of the plurality of rigging points is positioned along an upper edge of the plurality of display panels.

3. The display panel system of claim 2, wherein a second subset of the plurality of rigging points is positioned along a lower edge of the plurality of display panels.

4. The display panel system of claim 3, wherein the rigging line is threaded through the first subset of the plurality of rigging points.

5. The display panel system of claim 4, further comprising a second truss connected to a second rigging line that secured to the second subset of the plurality of rigging points.

6. The display panel system of claim 5, wherein the rigging line is threaded through a grommet of the first subset of the plurality of rigging points.

7. The display panel system of claim 6, wherein the second rigging line is threaded through a grommet of the second subset of the plurality of rigging points.

8. The display panel system of claim 2, wherein the plurality of rigging points are rigging line receiving passageways includes grommets extend thereabout.

9. The display panel system of claim 8, further comprising a plurality of suspension mechanisms secured to a rear surface of the plurality of planar polygonal display panels.

10. The display panel system of claim 9, wherein the plurality of suspension mechanisms are positioned adjacent to the plurality of rigging points.

11. The display panel system of claim 9, wherein plurality of suspension mechanisms are D-rings.

12. The display panel system of claim 1, wherein the plurality of rigging points are rigging line receiving passageways through which the rigging line are provided to suspend or secure the plurality of planar polygonal display panels to a first truss element.

13. A display panel system comprising:

a truss element;

a rigging line extending from the first truss element;

a plurality of planar polygonal display panels, each display panel having a zipper assembly positioned along an edge thereof and connectible to an adjacent display panel having a corresponding zipper assembly; and a plurality of rigging points positioned along an edge of the display panels, a first subset of the plurality of rigging points positioned along an upper edge of the plurality of display panels and a second subset of the plurality of rigging points positioned along a lower edge of the plurality of display panels, the rigging line threaded through the first subset of the plurality of rigging points to suspend or secure the plurality of planar polygonal display panels to the truss element, wherein the plurality of rigging points are rigging line receiving passageways, and wherein the rigging line receiving passageways include grommets each extending thereabout.

14. The display panel system of claim 13; further comprising a second truss element and a second rigging line extending from the second truss element.

15. The display panel system of claim 14; further comprising a second subset of the plurality of rigging points positioned along a lower edge of the plurality of display panels, the second rigging line threaded through the second subset of the plurality of rigging points to secure the plurality of planar polygonal display panels to the second truss element.

* * * * *